US005593184A

United States Patent [19]

Dengler

[11] Patent Number: 5,593,184

[45] Date of Patent: Jan. 14, 1997

[54] LOOSE-LEAF BINDER WITH SUSPENSION DEVICE

[75] Inventor: Wolfgang Dengler, Berlin, Germany

[73] Assignee: Off Data GmbH, Berlin, Germany

[21] Appl. No.: 367,694

[22] Filed: Jan. 3, 1995

[30] Foreign Application Priority Data

Jan. 4, 1994 [DE] Germany ..... 44 00 061.8

[51] Int. Cl.[6] ..... B42D 17/00

[52] U.S. Cl. ..... 281/43

[58] Field of Search ..... 281/43, 15.1, 51; 493/947

[56] References Cited

U.S. PATENT DOCUMENTS

| | | | |
|---|---|---|---|
| 4,400,107 | 8/1983 | Pitts | 281/43 X |
| 5,295,622 | 3/1994 | Lorber | 402/79 X |

FOREIGN PATENT DOCUMENTS

| | | | |
|---|---|---|---|
| 3890989 | 11/1989 | Australia | 493/947 |
| 0258464 | 3/1988 | European Pat. Off. . | |
| 0328751 | 8/1989 | European Pat. Off. | 493/947 |
| 4118117 | 12/1992 | Germany . | |
| 8801929 | 4/1989 | Netherlands | 493/947 |
| 9002661 | 3/1990 | WIPO | 493/947 |

*Primary Examiner*—Willmon Fridie, Jr.
*Attorney, Agent, or Firm*—Collard & Roe, P.C.

[57] ABSTRACT

A one-piece loose-leaf binder cut from a foil-like material. A set of perforations forms a suspension element which is separated from the remainder of the loose-leaf binder and folded back along a fold line, which is parallel to an edge of the loose-leaf binder. The folded suspension element extends beyond each edge of the binder to engage a pair of parallel rails.

5 Claims, 2 Drawing Sheets

LOOSE-LEAF BINDER WITH SUSPENSION DEVICE

BACKGROUND OF THE INVENTION

1. Field of the Invention

The invention relates to a loose-leaf binder equipped with a suspension device. More particularly, the invention relates to suspension arms which are formed by a cut-out across the spine of the loose-leaf binder.

2. The Prior Art

Loose-leaf binders are suspended from rails in a rack or cabinet in order to store and organize the loose-leaf binders. The suspension arms are made from metal or a metal reinforced material and are located at the center or end of the spine of the loose-leaf binder. When the loose-leaf binder is constructed, the suspension arm is connected to the spine in order to reinforce the binder. Constructing the loose-leaf binders with the attached suspension arms is relatively complicated and expensive.

German Patent DE 41 18 117 A1 and European Patent EP 258 464 A1 describe the manufacture of a one-piece loose-leaf binder cut from a flexible plastic foil. Although these loose-leaf binders can be simply manufactured, fitting them with the above-described conventional suspension arms complicates their construction. Therefore, it would be desirable to simply and inexpensively construct a one-piece loose-leaf binder with integrally formed suspension arms.

SUMMARY OF THE INVENTION

It is, therefore, an object of the present invention to overcome the drawbacks of the prior art and to provide a one-piece loose-leaf binder with integrally formed suspension arms.

It is a further object of the present invention to form the suspension arms by perforating the loose-leaf binder across its spine.

These and other related objects are achieved according to the invention by a device for binding and suspending loose-leaf paper comprising a one-piece loose-leaf binder cut from a foil-like material. The binder includes a spine with two spaced opposite margins and a suspension element formed by perforations in each margin. The loose-leaf binder includes a lateral edge bordering each margin. Each of the suspension elements is formed by a perforated fold line, with two ends, extending parallel to the corresponding lateral edge and an incision beginning and terminating at the perforated fold line ends. The incision consists of a rectilinear cut line with two ends extending parallel to the corresponding lateral edge and two convex cut lines, formed at the ends of the rectilinear cut line. The incision further consists of two concave cut lines communicating with the two convex cut lines and two further cut lines communicating with the two concave cut lines and extending to the perforated fold line ends, at an angle of 45° with the spine.

Each suspension element is separated from the loose-leaf binder along the incision and folded along the fold line to form a suspension nose at each lateral edge. The one-piece loose-leaf binder is made from an elastic plastic, for example, polypropylene.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
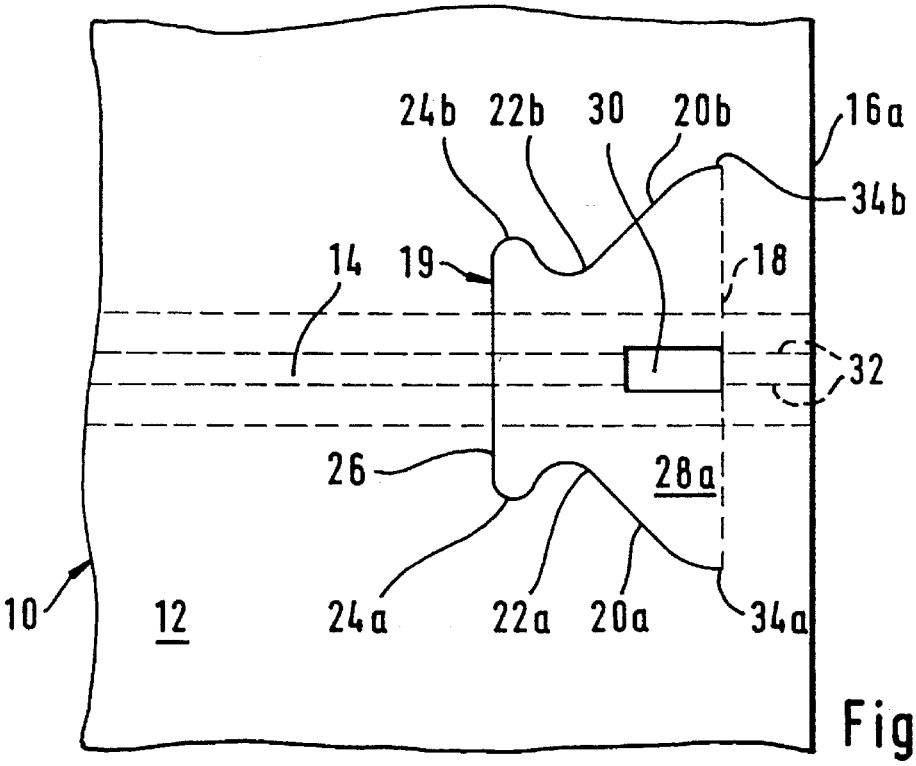
FIG. 1 is a fragmentary top plan view of a loose-leaf binder according to the invention with a cut out forming a suspension arm.
Figure 2:
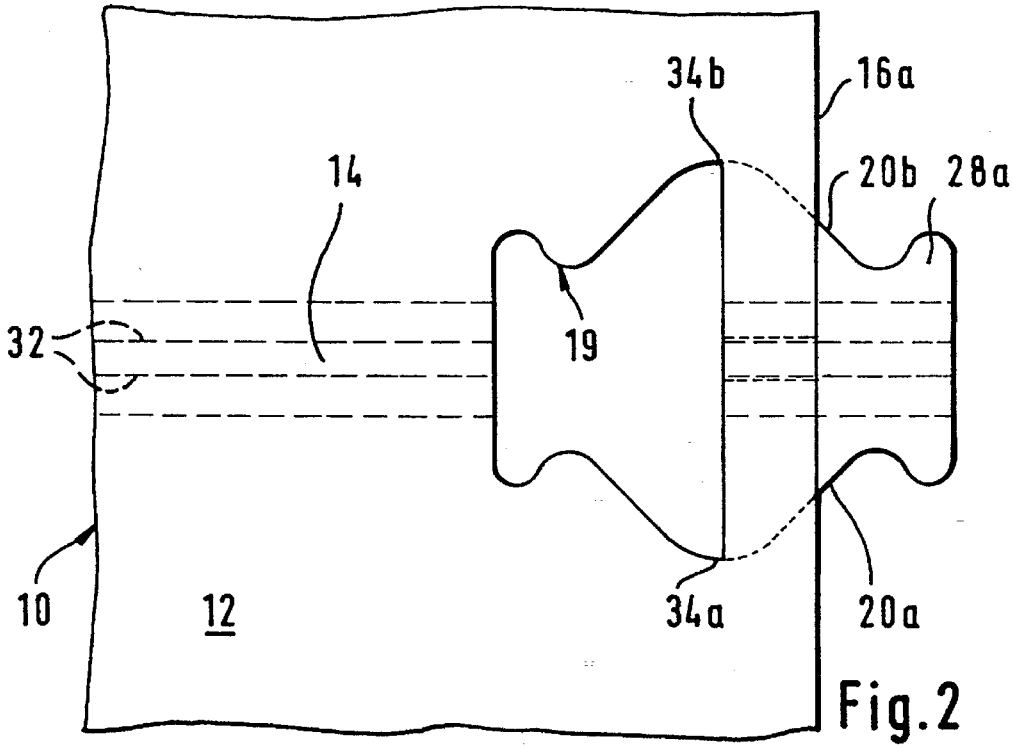
FIG. 2 is a fragmentary top plan view with the suspension arm folded out.

Referring now in detail to the drawings, and in particular FIGS. 1 and 2, there is shown a one-piece construction 10 cut from a foil-like material to form a loose-leaf binder 12. A portion of loose-leaf binder 12 is shown with spine 14 adjacent a top edge 16A. Spine 14 extends along the length of loose-leaf binder 12 to bottom edge 16B, and is oriented transversely with respect to edges 16A and 16B. While only a single suspension element 28A is shown and described, it should be understood that the description also applies to an additional suspension arm formed adjacent bottom edge 16B.

FIGS. 1 and 2 show a top or right suspension element 28A formed by a perforated fold line and a perforated incision. A fold line 18 is formed by perforating or punching along a line parallel to and spaced from top edge 16A. Fold line 18 includes two ends 34A and 34B. An incision 19 extends from end 34A away from top edge 16A, across spine 14 and back toward top edge 16A to end 34B. Incision 19 consists of two cut lines 20A and 20B which extend from ends 34A and 34B, respectively, toward spine 14. Cut lines 20A and 20B initially extend perpendicular to fold line 18 at ends 34A and 34B. Cut lines 20A and 20B then curve toward spine 14 to form an angle of approximately 45° with fold line 18.

Concave cut lines 22A and 22B then form two semicircles which first head toward each other before curving away from each other. Convex cut lines 24A and 24B then form inversely oriented semi-circles which head away from each other before curving back and facing each other across spine 14. A rectilinear cut line 26 then connects the ends of convex cut lines 24A and 24B. Rectilinear cut line 26 extends parallel to fold line 18 and top edge 16A. Cut lines 20A, 20B, 22A, 22B, 24A, 24B and 26, which are in communication with each other, form a continuous incision 19 extending from end 34A to end 34B.

A rectangular recess 30 is formed adjacent fold line 18 extending into connection element 28A, away from top edge 16A. The height of recess 30 is slightly greater than the space between the two adjacent center fold lines 32. The width of recess 30 is slightly greater than the perpendicular distance between fold line 18 and top edge 16A.

FIG. 2 shows suspension element 28A after incision 19 has been cut and fold line 18 has been pressed or punched. Connection element 28A is folded down into the page and to the right by rotating it 180° clockwise. As a result, the bottom surface of connection element 28A, which was not visible in FIG. 1, is now partly visible as connection element 28A extends beyond top edge 16A. As can be appreciated, the region between fold line 18 and top edge 16A now consists of a double layer of material. Recess 30 which spans center fold lines 32 allow loose-leaf folder 12 to be easily bent and folded along spine 14. Suspension element 28A is easily folded back because incision 19 forms a right angle with fold line 18 at ends 34A and 34B.

Figure 3:
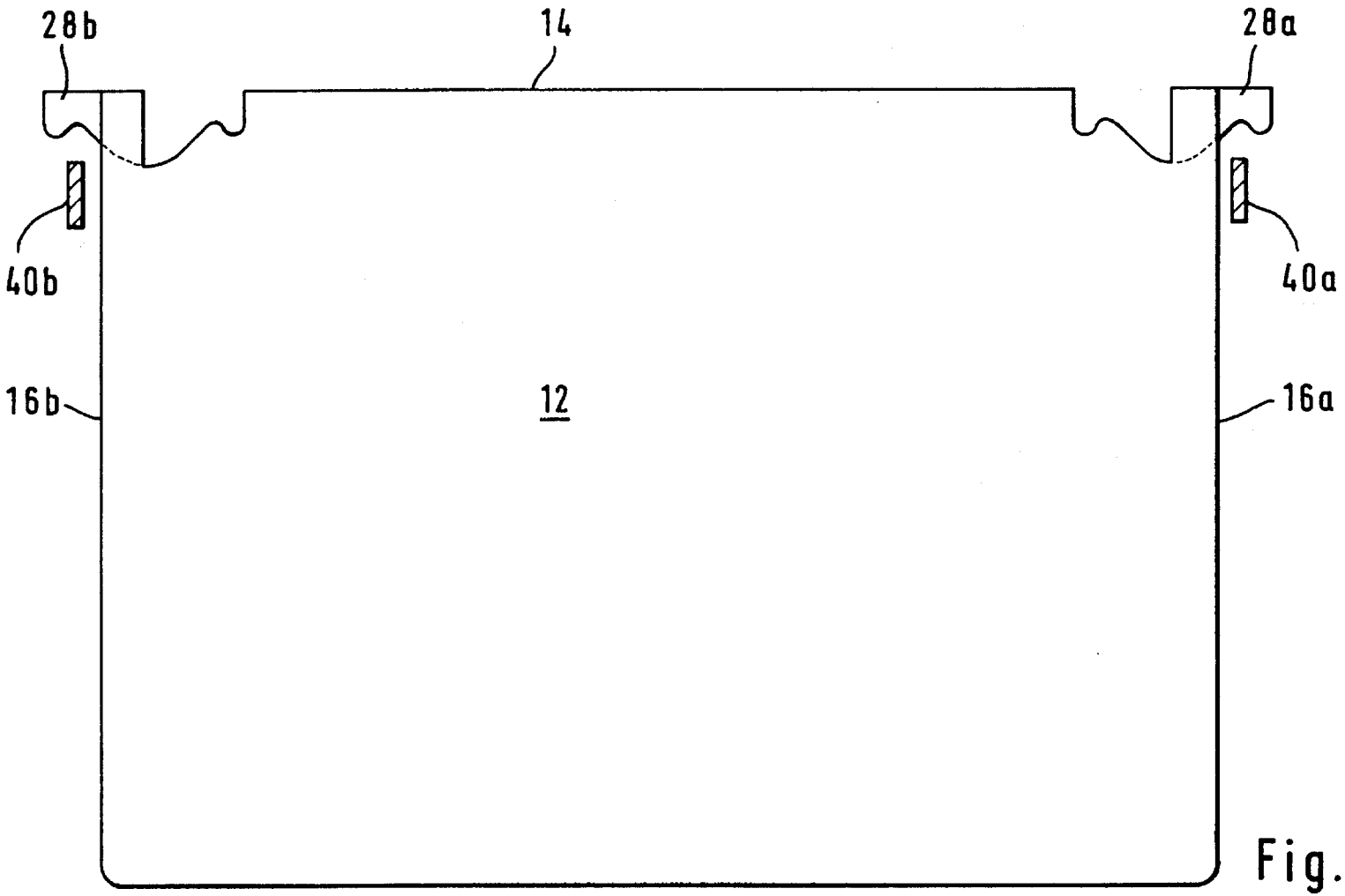
FIG. 3 is a side-elevational view of the folded loose-leaf binder with the extension arms.

Suspension element 28B at the opposite edge is folded 180° counterclockwise to extend in the opposite direction beyond the far edge of loose-leaf binder 12. Loose-leaf binder 12 is then folded along spine 14 with the resulting structure being shown in FIG. 3. As loose-leaf binder 12 is folded along spine 14, only the lower half of binder 12 and connection arms 28A and 28B are visible. Rails 40A and 40B are shown, which are part of a rack or cabinet. Rails 40A and 40B are parallel, horizontally-extending rails, for example. Loose-leaf binder 12 is dropped down in between rails 40A and 40B with connection elements 28A and 28B engaging rails 40A and 40B, respectively. More specifically, rails 40A and 40B sit within the upwardly curving recesses formed by concave cut lines 22A and 22B. Connection elements 28A and 28B are prevented from shifting on rails 40A and 40B by their downwardly extending portions formed by convex cut lines 24A and 24B and cut lines 20A and 20B. Incision 19 basically consists of rectilinear cut line 26 with two mirror image S-shaped cuts communicating with each end thereof.

While only a single embodiment of the present invention have been shown and described, it is to be understood that many changes and modifications may be made thereunto without departing from the spirit and scope of the invention as defined in the appended claims.

What is claimed is:

1. A device for binding and suspending loose-leaf paper, comprising:

a one-piece loose-leaf binder cut from a material sheet, said binder including two spaced-opposite lateral edges, a margin adjacent each lateral edge and a spine; and a suspension element formed by perforations in each margin, wherein each of said suspension elements is formed by a perforated fold line, with two ends, extending parallel to the corresponding lateral edge and a perforated incision beginning and terminating at said perforated fold line ends, the incision comprising:

(a) a rectilinear cut line, with two ends, extending parallel to the corresponding lateral edge;

(b) a convex cut line communicating with each end of said rectilinear cut line;

(c) a concave cut line communicating with each convex cut line; and (d) a further cut line communicating with each concave cut line and extending to one end of said perforated fold line at an angle of 45° with said spine.

2. The device according to claim 1, wherein each suspension element is separated from said loose-leaf binder along the incision and folded along the fold line to form a suspension nose at each lateral edge.

3. The device according to claim 2, wherein said one-piece loose-leaf binder is made from an elastic plastic.

4. The device according to claim 3, wherein said elastic plastic is polypropylene.

5. A device for suspending a loose-leaf binder having a top edge, a spaced opposite bottom edge parallel to said top edge, and a spine extending transversely between the top and bottom edge, on two spaced, parallel, horizontally-extending rails, the device comprising:

a suspension nose located adjacent each edge, each suspension nose formed by a fold line and a curved incision both extending across the spine of the loose-leaf binder, the incision beginning and terminating at the fold line which extends generally parallel to the edges;

said suspension noses being displaced 180°, in opposite directions from each other, along respective fold lines, to extend beyond the adjacent edge for engaging the horizontally-extending rails to suspend the loose-leaf binder therefrom.

* * * * *